US006749165B2

(12) United States Patent
Immerman

(10) Patent No.: US 6,749,165 B2
(45) Date of Patent: Jun. 15, 2004

(54) HOLDER ASSEMBLY HAVING AN EMBEDDED HOOK AND SECURING MEMBER

(75) Inventor: Robert A. Immerman, Moreland Hills, OH (US)

(73) Assignee: InterDesign, Inc., Solon, OH (US)

( * ) Notice: Subject to any disclaimer, the term of this patent is extended or adjusted under 35 U.S.C. 154(b) by 0 days.

(21) Appl. No.: 10/119,411

(22) Filed: Apr. 9, 2002

(65) Prior Publication Data

US 2003/0189147 A1 Oct. 9, 2003

(51) Int. Cl.[7] ..... F16B 45/00; F16B 47/00
(52) U.S. Cl. ..... 248/304; 248/205.5
(58) Field of Search ..... 248/304, 302, 248/205.1, 205.3, 206.2, 206.5, 301, 303

(56) References Cited

U.S. PATENT DOCUMENTS

| | | | | | |
|---|---|---|---|---|---|
| 280,639 | A | * | 7/1883 | Lipe | 248/297.51 |
| 398,679 | A | * | 2/1889 | White | 248/205.5 |
| 2,687,836 | A | * | 8/1954 | Rhodes et al. | 224/556 |
| 3,078,017 | A | * | 2/1963 | Waskonig et al. | 222/181.3 |
| 3,109,619 | A | * | 11/1963 | Krug et al. | 248/690 |
| 3,239,178 | A | * | 3/1966 | Pompa | 248/205.3 |
| 3,552,705 | A | * | 1/1971 | Caster | 248/309.4 |
| 3,660,861 | A | * | 5/1972 | Delmonico | 15/209.1 |
| 4,073,462 | A | * | 2/1978 | Whitaker | 248/537 |
| 4,074,882 | A | * | 2/1978 | Anderson | 248/208 |
| 4,197,616 | A | * | 4/1980 | Panuski | 160/349.2 |
| 4,279,396 | A | * | 7/1981 | Bendock | 248/205.5 |
| 4,480,939 | A | * | 11/1984 | Upton | 401/201 |
| 4,678,150 | A | * | 7/1987 | Newman et al. | 248/205.3 |
| 4,734,027 | A | | 3/1988 | Adams | |
| 5,078,356 | A | * | 1/1992 | Adams | 248/206.2 |
| D333,583 | S | * | 3/1993 | Hurd | D6/526 |
| 5,318,262 | A | * | 6/1994 | Adams | 248/205.8 |
| 5,433,413 | A | * | 7/1995 | Adams | 248/205.3 |
| 5,553,823 | A | * | 9/1996 | Protz, Jr. | 248/304 |
| 5,593,122 | A | * | 1/1997 | Robertson et al. | 248/222.12 |
| 5,595,364 | A | * | 1/1997 | Protz, Jr. | 248/205.5 |
| 5,730,413 | A | * | 3/1998 | Chen | 248/303 |
| 6,131,865 | A | * | 10/2000 | Adams | 248/206.2 |
| 6,224,030 | B1 | * | 5/2001 | Hepworth | 248/215 |
| 6,273,279 | B1 | * | 8/2001 | Wolf | 248/304 |
| 6,279,862 | B1 | * | 8/2001 | Gershowitz | 248/216.1 |
| 6,302,365 | B1 | * | 10/2001 | Catanzarite et al. | 248/304 |
| 6,325,344 | B1 | * | 12/2001 | Gary et al. | 248/206.3 |
| 6,557,807 | B1 | * | 5/2003 | Belanger | 248/215 |

FOREIGN PATENT DOCUMENTS

| | | | |
|---|---|---|---|
| FR | 1479570 | * | 5/1967 |
| GB | 2167483 A | * | 5/1986 |
| JP | 04064706 A | * | 2/1992 |

* cited by examiner

*Primary Examiner*—Anita King
(74) *Attorney, Agent, or Firm*—D. Peter Hochberg; Sean Mellino; Katherine R. Vieyra

(57) ABSTRACT

A durable holder assembly having improved mechanical and aesthetic qualities to hold heavy objects. The support portion for the assembly is formed via injection molding. The support portion contains on one side a structure for securing the hook to a surface such as a magnet, an adhesive, a suction cup, Velcro or a mechanical device such as an over-the-door bracket. The structure that secures the holder assembly to a surface is integrally formed with the support portion therein. A holding member, such as a hook, is also integrally formed with the support portion and extends downwardly from the support portion for supporting objects.

4 Claims, 3 Drawing Sheets

HOLDER ASSEMBLY HAVING AN EMBEDDED HOOK AND SECURING MEMBER

BACKGROUND OF THE INVENTION

1. Field of the Invention

The present invention relates to supports for connection members for hooks, particularly injection-molded supports for hooks. The invention further relates to integrally molded connection members for suction cups, hooks and other component parts.

2. Description of the Prior Art

Hooks and other fixtures are affixed or secured to a vertical surface in order to hold other objects. Such hooks and other fixtures are commonly secured to the vertical surface via a securing device, such as a suction cup, adhesives, magnets and mechanically engaging devices, such as an over-the-door hook. Hooks and other fixtures held by suction cups are attached to the suction cup by affixing the hook or other fixture over the neck of the cup. The neck generally has a cylindrical portion with an enlarged end. The end is either compressed or twisted as it engages the hook or fixture.

In other instances, a hole is provided in the hook or fixture into which the suction cup's neck is inserted. In each case, there is a loose fitting between the hook or other fixture and the suction cup, which renders the assembly (1) unstable, (2) prone to having the hook or assembly come apart, (3) reduces load capacity in that the hook could be disassembled from the neck due to torque caused by the heavy load on the neck, and (4) an unaesthetic appearance in that it at least looks like the hook or item could fall off the suction cup.

Another disadvantage with such conventional hooks is that hooks, by their nature, have a generally thin composition in order to hold objects in a more secure manner, such as clothing. However, such a thin make-up causes conventional hooks to be weak and facilitates potential cracking or breaking when the hooks are plastic. With conventional hooks fit to be secured over the top of a door, the portion secured over the top of the door must be thin enough so as not to cause damage to the door or door jamb and so as not to prevent the door from being opened or closed. This thin portion fitting over the top of a door is also an area of weakness that is prone to cracking or breaking when made of plastic.

Still yet another disadvantage is that many conventional hooks are secured to suction cups or other securing aids by glue, or other adhesives. For example, a hook may be glued to a magnet for securing to a magnetic surface. The glue or other adhesive often times dries out or loses its adhesive qualities, thus causing the securing aid to become separated from the hook.

U.S. Pat. No. 4,734,027 (Adams) describes a mold for the injection molding of suction cup devices. The patent describes a mold and method for molding suction cups in which plastic is injected into a mold cavity that is defined by at least two mold sections that define a suction cup. The disclosed mold allegedly prevents the formation of plastic protrusions from the suction cup upon formation. Adams is basically an example of a mold for molding a suction cup and therefore has little relevance to the present invention.

Hooks, which are well known in the industry, are generally an integral unit made of one material, such as a solid metal or a solid plastic, and can be secured over the top of a door or secured to a surface by a method as stated above. These hooks though are generally not comprised of differing materials, such as one part plastic and another part metal.

Injection molding is a process that is common and well known in the industry. The injection molding process involves the use of two or more dies which fit together to create an enclosed cavity. The cavity is formed in any desirable shape. Molten plastic is injected into the cavity and allowed to cool, thus forming a plastic figure of the desired shape. Objects, such as stainless steel hooks, magnets, adhesives, fixtures, mechanical devices, and the like, can be partially inserted into the die so as to become incorporated within the injection-molded plastic upon cooling.

SUMMARY OF THE INVENTION

It is an object of the present invention is to provide a holder assembly for a hook or other connection member, having a support portion that is integrally formed with hooks, holding devices such as containers, mirror holders, or other devices forming part of the holder assembly for holding other items on the holder assembly, such as articles of clothing, tools, kitchen or bathroom accessories and the like. The term "support portion", as used herein, means the portion of the holder assembly made of a material such as a thermoplastic, into which the hook or other holding device is firmly fixed.

It is another object of the present invention is to provide a holder assembly having a support portion that is integrally formed with a securing member, such as a suction cup, magnet, adhesive, Velcro device, or a mechanical support device, for securing the holder assembly to another structure, whereby the support portion is immovable and fixed with respect to the securing member and a part of the securing member is integrally formed with the support portion and another part of the securing member is exposed and extends outwardly from the support portion for securing the holder assembly to a surface of a supporting structure.

It is yet another object of the present invention to provide a holder assembly having a support portion that is integrally formed with a securing member so that the hook or other holding device can be secured to a smooth surface.

It is still yet another object of the present invention to provide a holder assembly having a highly aesthetic appearance.

These and other objects of the invention may occur to those skilled in the art from the description to follow and from the appended claims.

DETAILED DESCRIPTION OF THE INVENTION

Figure 1:
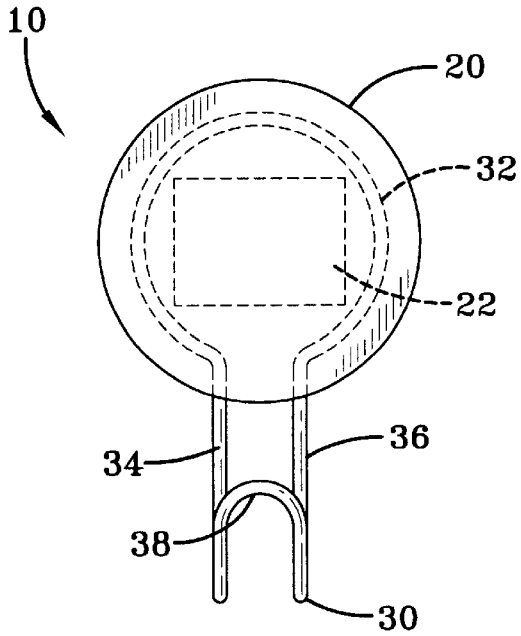
FIG. 1 is a front view of a holder assembly that has a support portion integrally molded with a holding member in the form of a hook.

The present invention is now described with reference to the drawings, wherein like reference numerals are used to refer to like elements throughout. In the following description, for purposes of explanation, numerous specific details are set forth in order to provide a thorough understanding of the present invention. It will be evident, however, to one skilled in the art that the present invention may be practiced without these specific details.

The preferred embodiments of the present invention are now herein described. Referring now to FIG. 1, one of the preferred embodiments of a holder assembly according to the present invention is shown and referred to generally at numeral 10. For purposes of explanation, the invention is shown as a holder assembly 10 having an accessible hook. In this embodiment, holder assembly 10 comprises a support portion 20, an assembly securing member 22 and a holding member 30 in the form of an accessible hook. However, it is noted that holding member 30 can comprise a variety of other devices as well, such as soap dispensers, hanging shower baskets, hanging shower containers, toothbrush holders, razor holders, shower caddies, hanging mirror holders, toilet tissue holders, toilet tissue dispensers, towel rings, and the like. Support portion 20 is composed of a moldable, thermoplastic that is made via conventional injection-molding methods. Injection-molding methods and procedures are well known in the art and for purposes of brevity a thorough explanation of injection-molding methods and procedures is herein omitted.

Holding member 30 comprises an embedded portion 32 and a non-embedded portion 34. Embedded portion 32 of holding member 30 is embedded within support portion 20 by injection-molding and non-embedded portion 34 of holding member 30 extends downwardly (or in any other direction) from within support portion 20 to ultimately provide the structure for supporting objects. Holding member 30 further includes a pair of substantially parallel coplanar legs 36 extending downwardly from support portion 20 and ending in a lower curve 38 which extends outwardly from legs 36 to support other objects. Any number of substantially parallel legs 36 may be employed.

Figure 2:
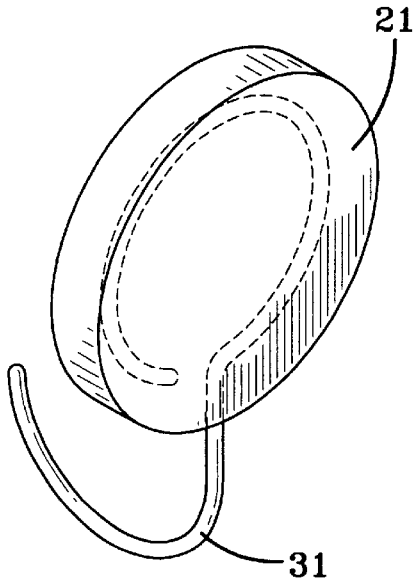
FIG. 2 is a perspective view of an alternative embodiment of a holder assembly having a support portion that is integrally molded with a hook.

Alternatively, holding member 31 (FIG. 2) may comprise a single solid metal member, or other like material, which extends downwardly from support portion 21 and curves upwardly and outwardly to support other objects. Holding member 31 (FIG. 2) is comprised of a durable material, such as stainless steel, but may alternatively be comprised of any other durable material conventional in the art, such as an injection-molded plastic or polyethylene, and the like. Support portion 21 comprises a translucent, clear, opaque, or solid injection-molded plastic that is molded over hook 31 and is formed into any desirable shape or design, such as a circle, square, rectangle, and the like.

Assembly securing member 22 provides support to holder assembly 10 and secures holder assembly 10 to a structure, such as a door, wall, cabinet or appliance. Additionally, assembly securing member 22 is embedded into thermoplastic support portion 20 and extends outwardly therefrom, as will be explained in greater detail below. In this regard, assembly securing member 22 could be an adhesive, a magnet, a suction cup, Velcro or a mechanical securing device such as an over-the-door hook for securing hook assembly 10 to a structure.

Figure 3:
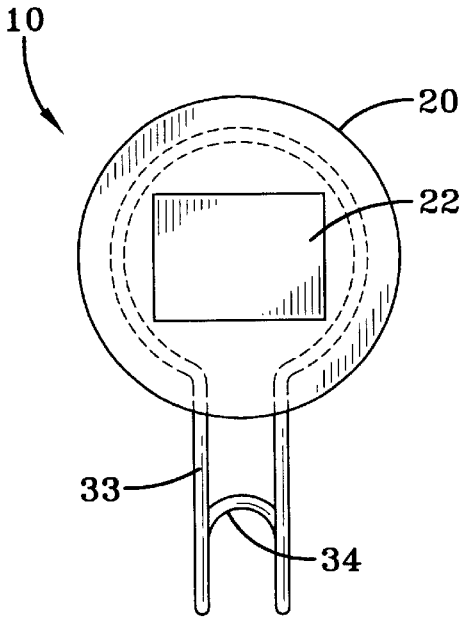
FIG. 3 is a rear view of a holder assembly that is integrally molded with a hook and having a support portion.
Figure 3A:
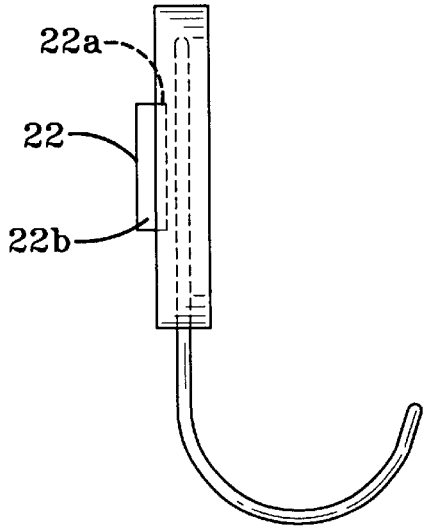
FIG. 3*a* is a side view of a holder assembly shown in FIG. 3.

Referring now to FIG. 3, holder assembly 10 is shown from its posterior end. In this embodiment of holder assembly 10, assembly securing member 22 comprises a securing device for securing hook assembly 10 to a vertical, planar surface. Examples of a securing device which may be used to comprise assembly securing member 22 include a magnet, adhesive tape with a peelable backing fixed on a solid base or foundation, or Velcro fixed on a solid base or foundation so that hook assembly 10 can be secured to a variety of smooth, vertical surfaces. Assembly securing member 22 is preferably molded in support portion 20 along with holding member 30. As seen in FIG. 3*a*, assembly securing member 22 comprises a solid base or foundation 22*a* which is embedded in support portion 20 and the exposed, or non-embedded portion 22*b*, extends outwardly therefrom.

Figure 4:
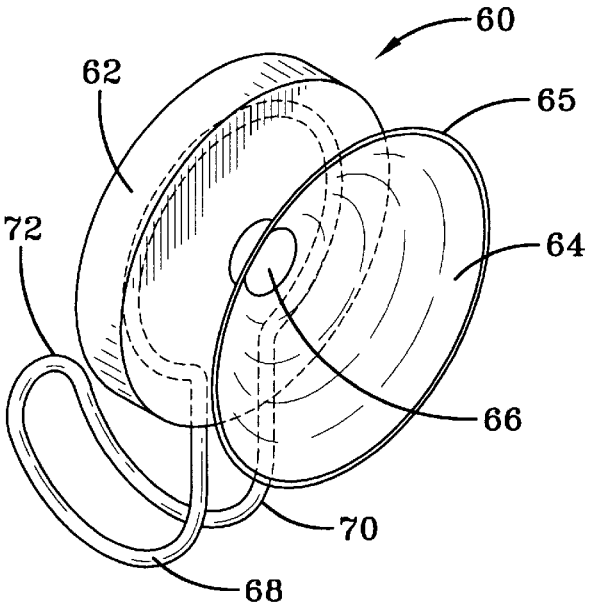
FIG. 4 is a perspective view of a holder assembly that has a support portion integrally molded with an assembly securing member in the form of a suction cup.

Turning now to FIG. 4, another preferred embodiment of holder assembly is shown and referred to at numeral 60. In this embodiment, an assembly securing member 64 is provided comprising a suction cup portion 65 and a neck portion 66 that is molded in and embedded with a support portion 62, thereby securing assembly securing member 64 in support portion 62 and allowing suction cup portion 65 of assembly securing member 64 to extend outwardly therefrom. Of course suction cup 65 can be any type of suction cup conventional in the art, such as a flexible thermoplastic or rubber suction cup.

Figure 5:
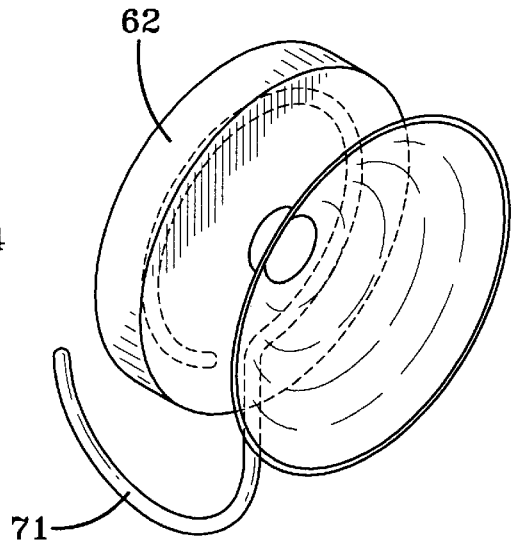
FIG. 5 is a perspective view of an alternative embodiment of the holder assembly shown in FIG. 4.

Holder assembly 60 further comprises a holding member 68 in the form of an accessible hook extending downwardly from support portion 62. Holding member 68 further includes a pair of substantially parallel, coplanar legs 70 extending downward from support portion 62 and ending in a lower curve 72 from which the legs 70 can support other objects, as explained above. Alternatively, holding member 68 can comprise a single solid leg 71 (FIG. 5) that extends downwardly from support portion 62 and curves upward to support other objects.

Figure 7:
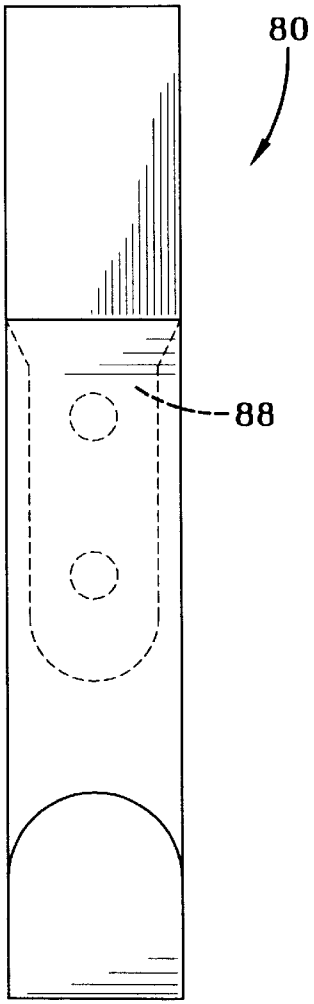
FIG. 7 is a front view of an over-the-door holder assembly shown in FIG. 6.
Figure 6:
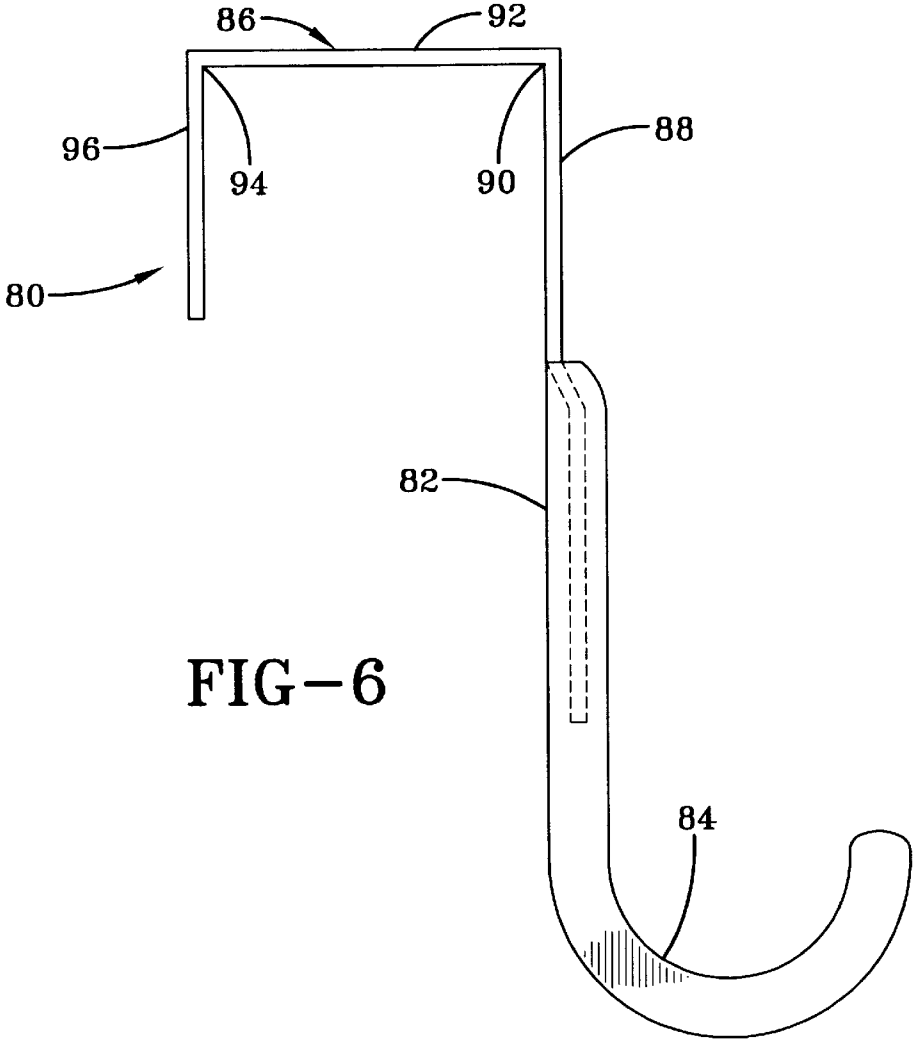
FIG. 6 is a side view of an over-the-door holder assembly having a plastic hook and an integrally molded metal over-the-door hanger or bracket.

Turning now to FIGS. 6 and 7, yet another preferred embodiment of the present invention is shown and referred to generally at numeral 80. Holder assembly 80 comprises a support portion 82 having a holding member 84 in the form of an accessible hook extending downwardly therefrom and an assembly securing member 86. In this embodiment, support portion 82 and holding member 84 are injection molded together from thermoplastic material to form a single unit and a first vertical member 88 of assembly support member 86 is embedded therein allowing assembly securing member 86 to extend upwardly and outwardly therefrom. In this embodiment, assembly securing member 86 comprises an over-the-door bracket, or an inverted, substantially "U" shaped bracket, having 90° corners engaging the top of a door so that hook assembly 84 is suspended therefrom. As stated above, assembly securing member 86 comprises a first vertical member 88 that extends upwardly from the top of support portion 82 so that the backside of first vertical member 86 and the backside of support portion 82 are substantially planar, although this is not required. First vertical member 88 comes to a first 90° angle 90 whereby assembly support member 86 extends via a horizontal member 92 in a direction away from support assembly 80 to a second 90° angle 94. At second 90° angle 94, assembly support member 86 extends downwardly via a second vertical member 96. First vertical member 88 and second vertical member 96 are substantially parallel to each other and both are substantially perpendicular to horizontal member 92. Horizontal member 92 should be at least equal in length to the thickness of the door from which the bracket will be disposed.

Figure 8:
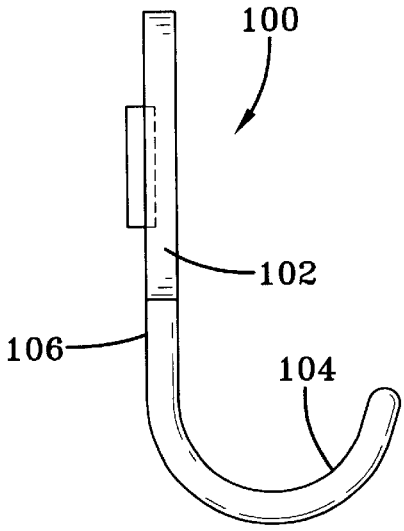
FIG. 8 is a side view of a holder assembly that is integrally molded with a hook and having a support portion and a hook portion that are a single unit.
Figure 9:
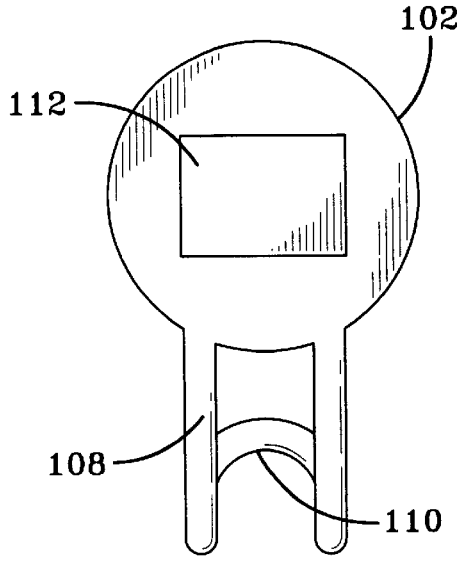
FIG. 9 is a rear view of the holder assembly shown in FIG. 8.

Referring lastly to the device shown in FIG. 8, another preferred embodiment of the present invention is shown and referred to generally at numeral 100. In this embodiment, a support portion 102 and a holding member 104 in the form of an accessible hook are combined and molded into a single, injection-molded unit 106. Holding member 104 of assembly 100 extends downwardly from support portion 102 to form a single unit. Holding member 104 further includes a pair of substantially parallel legs 108 (FIG. 9) extending downwardly from support portion 102 and ending in a lower curve 110 from which the legs 108 can support other objects. Alternatively, holding member 104 can comprise a single solid leg that extends downwardly from support portion 102 and curves upwardly to support other objects. Of course holder assembly 100 also includes an assembly securing member 112, as those described above.

The invention in its preferred form thus includes a holder assembly for supporting objects having an accessible hook or other holding member made of one material and/or a support portion made of another material, where one of the two materials is a thermoplastic so that the other material can be embedded and integral therewith.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. A holder assembly comprising:

a suction cup, having a neck and a deformable cup, for securing said holder assembly to a surface;

an accessible hook for holding and supporting objects from said holder assembly; and a support portion having said neck of said suction cup and a portion of said accessible hook integrally molded within said support portion, said support portion comprising thermoplastic material molded around said neck of said suction cup and said portion of said accessible hook so that said neck of said suction cup and said portion of said accessible hook are embedded therein, said deformable cup extending outwardly from said neck embedded in said support portion to secure said holder assembly to a structure, and said accessible hook extending downwardly from said support portion for holding and supporting objects.

2. A holder assembly comprising:

a support portion made of a moldable thermoplastic material;

a hook member partially embedded in the moldable material of said support portion, said hook member comprising a loop of wire having one curved portion embedded in the molded material and a pair of wires extending from said support portion, said pair of wires being joined together and bent to form a hook; and a suction cup having a neck and a deformable cup, said neck being partially embedded in said support portion and wherein said deformable cup extends outwardly from said neck and attaches said securing member along with the balance of said holder assembly to a structure.

3. A holder assembly comprising:

a support portion made of a moldable thermoplastic material;

a hook member partially embedded in the moldable material of said support portion, said hook member comprising a single piece of elongated metal having a free curled end forming a hook and an embedded end embedded in said support portion; and a suction cup having a neck and a deformable cup, said neck being partially embedded in said support portion and wherein said deformable cup extends outwardly from said neck and attaches said securing member along with the balance of said holder assembly to a structure.

4. A holder assembly comprising a support portion and a hook portion extending from said support portion, said support portion and said hook portion being integral and made from a hard moldable thermoplastic material, and a suction cup having a neck and a deformable cup, said neck being embedded in said support portion and said deformable cup extending outwardly from said neck for attaching said support portion along with the balance of said holder assembly to a structure.

* * * * *